United States Patent [19]

Frentress

[11] 4,364,502

[45] Dec. 21, 1982

[54] LINE SENSOR ARRANGEMENT

[75] Inventor: Zane Frentress, Stone Mountain, Ga.

[73] Assignee: Milliken Research Corporation, Spartanburg, S.C.

[21] Appl. No.: 161,929

[22] Filed: Jun. 23, 1980

[51] Int. Cl.[3] ..... B65H 25/02; B65H 25/26

[52] U.S. Cl. ..... 226/45; 226/3; 226/15

[58] Field of Search ..... 226/45, 10, 1, 3, 24, 226/15, 16; 360/84

[56] References Cited

U.S. PATENT DOCUMENTS

| | | | |
|---|---|---|---|
| 2,773,120 | 12/1956 | Masterson | 360/84 |
| 2,866,012 | 12/1958 | Ginsburg | 360/84 |
| 3,042,756 | 7/1962 | Buslik | 360/84 |
| 3,701,464 | 10/1972 | Crum | 226/16 |
| 3,784,072 | 1/1974 | Armstrong | 226/45 |
| 4,261,498 | 4/1981 | Short | 226/15 |

*Primary Examiner*—Edward J. McCarthy

*Attorney, Agent, or Firm*—Earle R. Marden; H. William Petry

[57] ABSTRACT

A rotating magnetic sensor which detects a ferrous line on a web of material and compares it with a reference registration line to either speed up or slow down the speed of the section of web material on which the ferrous line is located. The sensor employs a pole-piece, a coil, a permanent magnet and two signal wires.

1 Claim, 8 Drawing Figures

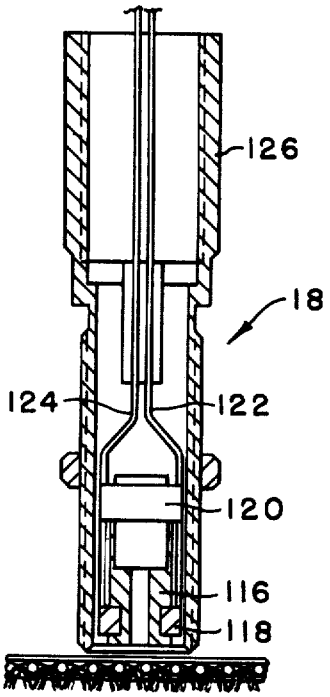
FIG.-7-
FIG.-8-
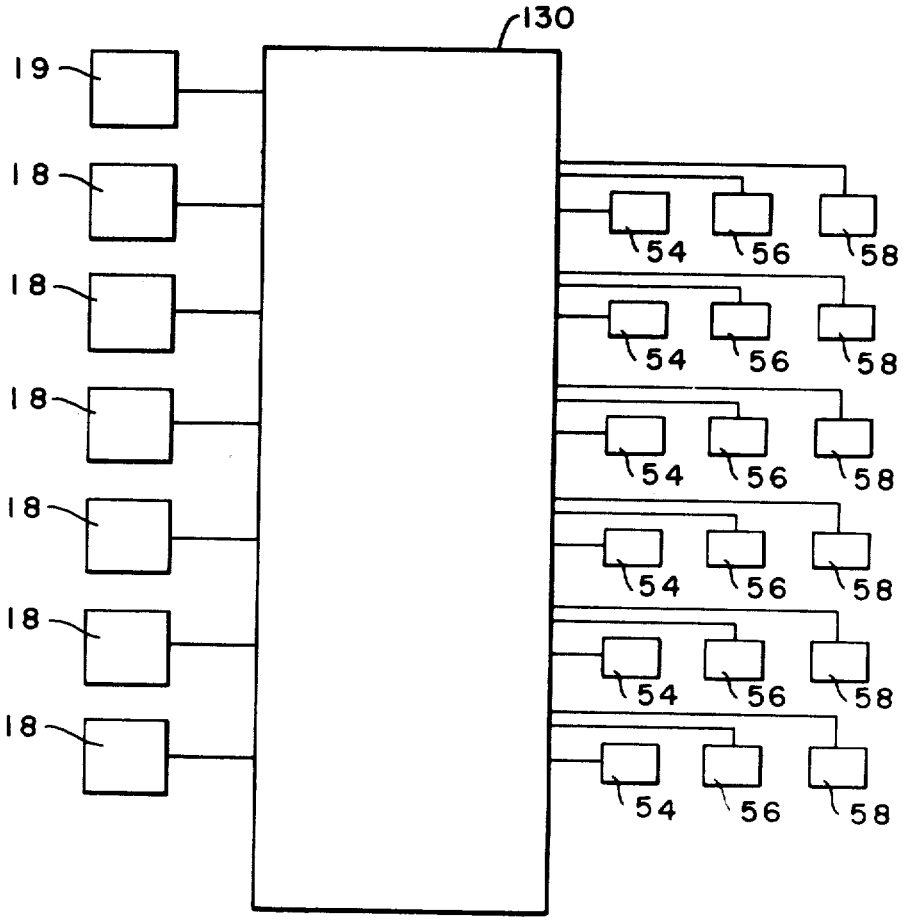

LINE SENSOR ARRANGEMENT

It is an object of the invention to provide an apparatus which will automatically control the bow and skew of a continuous web of textile material as it passes through certain processes such as dyeing, finishing and/or back-coating.

Other objects and advantages of the invention will become readily apparent as the specification proceeds to describe the invention with reference to the accompanying drawings, in which :

FIG. 7 is a cross-section view of the magnetic sensor in position relative to the fabric being sensed; and FIG. 8 is a schematic representation of the operation of the control system.

Figure 1:
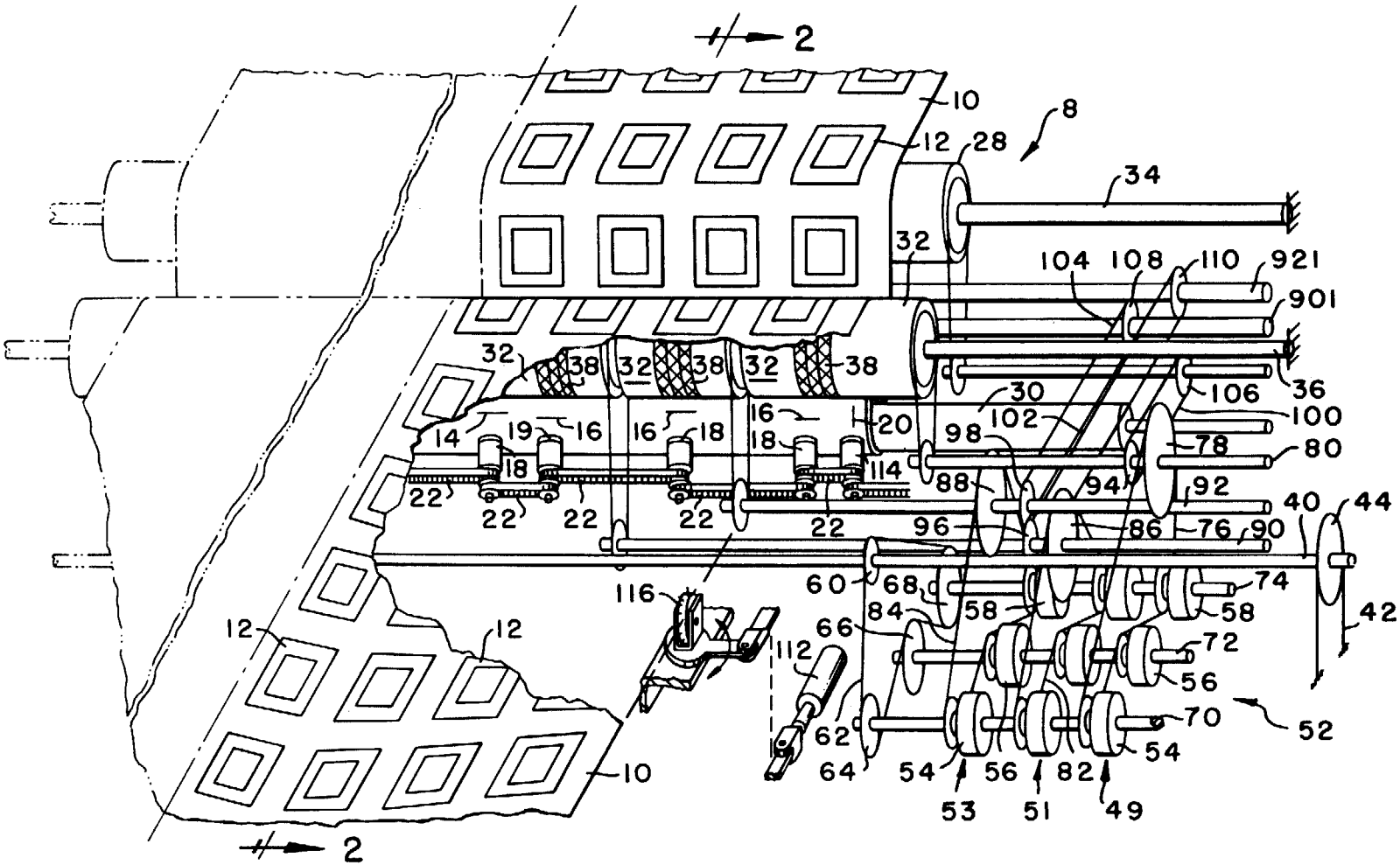
FIG. 1 is a schematic representation of the bow and skew control apparatus.

Looking now to the drawings and in particular to FIG. 1, schematically represented is the right hand half of a machine 8 to correct the bow and skew of an unfinished carpet 10 with a printed pattern 12 on the face thereof. For the purpose of detection and correction of the bow and skew of the carpet 10, a reference mark 14 and a plurality of detectable marks 16 are spaced across the back of the carpet 10. The marks 14 and 16 contain a ferrous material such as iron oxide or iron powder to provide a low reluctance path for the field of the magnetic sensors 18 and 19. An additional detector mark 20 is placed on both edges of the carpet for guiding and controlling the width thereof. In the preferred form of the invention, the marks 14 and 16 are approximately six inches in length with each set of marks being spaced longitudinally from the next adjacent set of marks, a distance of approximately two feet.

Figure 2:
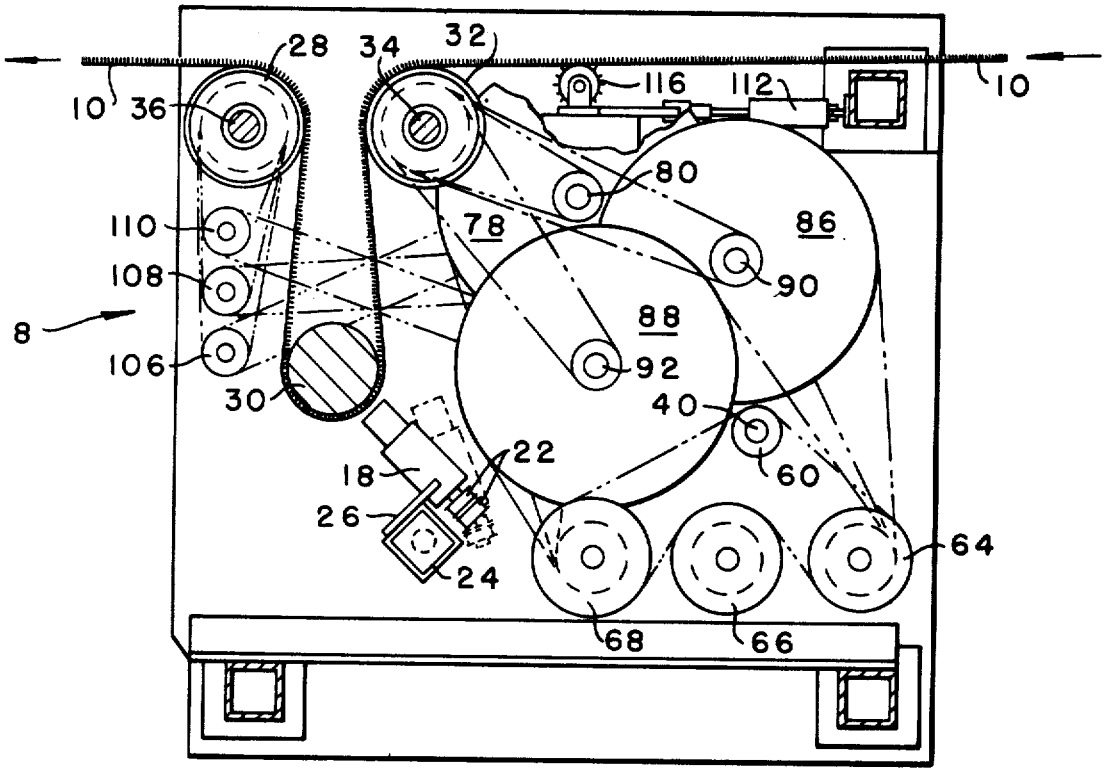
FIG. 2 is a section view on line 2—2 of FIG. 1.
Figure 3:
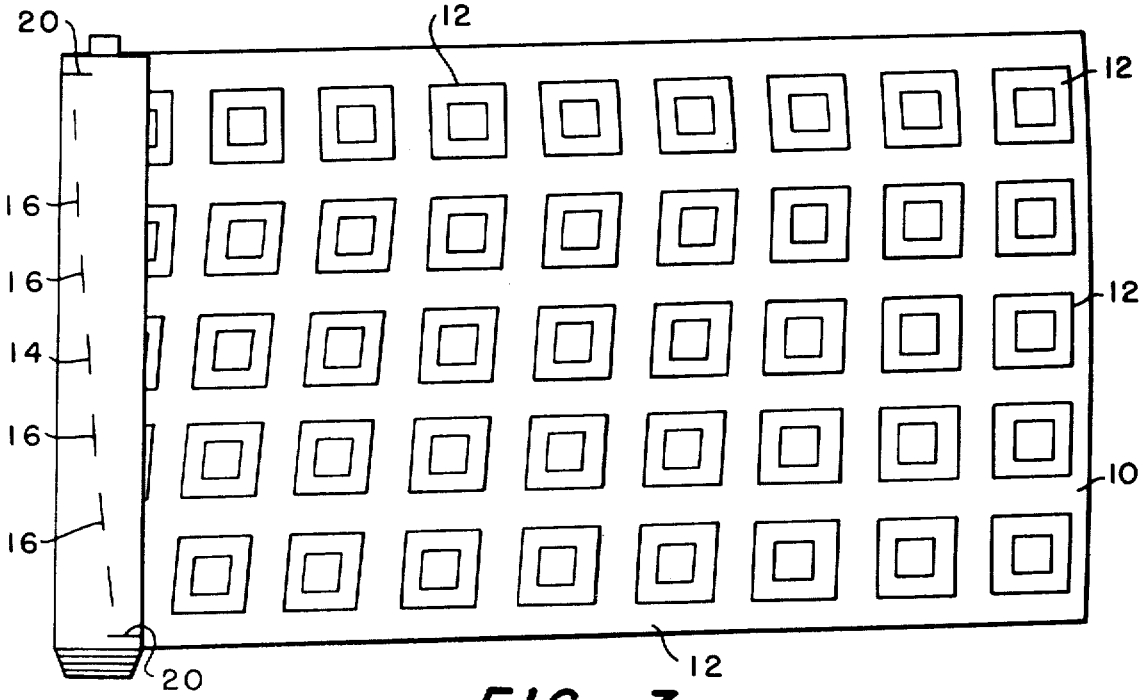
FIG. 3 represents a roll of unfinished fabric, such as carpet, with a bow and skew in the pattern.
Figure 4:
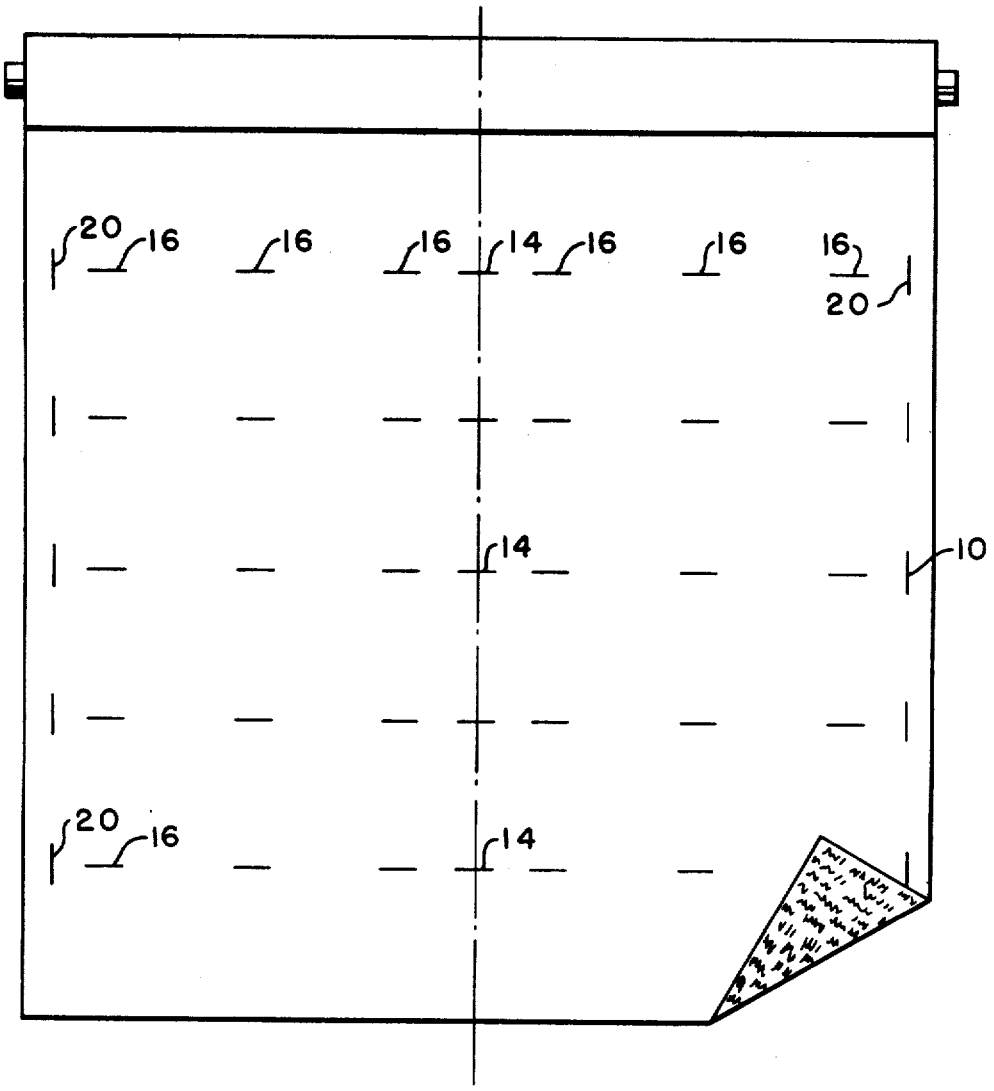
FIG. 4 represents the position of the registration lines on the back of a fabric to be controlled.

The magnetic sensors 18 and 19 are rotably mounted and driven by a series of timing belts 22 which in turn are driven by a drive motor (not shown). Looking at FIG. 2, each of the sensors 18 and 19 are connected to the rectangular frame member 24 by a suitable support 26. The rectangular frame 24 is mounted on journals and can be oscillated from the solid position to the dotted position to move the sensors out of the way of seams in the carpet 10.

The unfinished carpet 10 is supplied from a carpet machine such as a tufting machine (not shown) to the bow and skew machine 8 and then a further processing machine such as a back coater to coat the back of the carpet 10. The flow of the carpet 10 through the machine 8, as indicated by the arrows, is controlled by input segmented rolls 28, non-magnetic idler roll 30 and output segmented rolls 32. In the preferred embodiment of the invention there are six input rolls 28 and six output rolls 32. Each of the input rolls 28 are mounted for independent rotation on shaft 34 and each of the output rolls are mounted for independent rotation on shaft 36. Each segmented roll 28 and 32 has a center portion 38 that is covered with a suitable friction material to provide traction between the roll and the underside of the carpet 10.

A drive motor, not shown, drives the timing belts 24 for the magnetic sensors 18 and 19 and the main drive shaft 40 by means of a belt 42 and sprocket 44. The main drive shaft 40 extends across the machine and drives the rolls on the right hand side of the machine as shown in FIG. 1 as well as an identical drive arrangement of the left side of the machine, not shown.

As indicated, each of the rolls 28 and 32 are driven by the belt 42 operably connected to the sprocket 44 fixed to the drive shaft 40. Each roll 28 and 32 is driven by a separate shaft from the clutch bank generally designated by the reference numeral 52. The clutch bank 52 consists of rows 49, 51 and 53 each having a high speed electric clutch 54, a standard speed electric clutch 56 and a low speed electric clutch 58 for each set of rolls 28, 32 operably associated with the clutch bank.

The clutches 54, 56 and 58 are driven off the main drive shaft 40 from a sprocket 60 and chain 62 which drives the sprockets 64, 66 and 68 connected respectively to the low speed clutch shaft 70, the standard speed clutch shaft 72 and the high speed clutch shaft 74. The clutches of row 49 are connected by a chain 76 to a sprocket 78 which through countershaft 80 drives the first roll 32. In the same mannner clutches 51 and 53 are connected by chains 82 and 84, respectively to sprockets 86 and 88 to drive the third roll 32 and the center roll 32 through shafts 90 and 92. Each of the shafts 80, 90 and 92 have sprockets 94, 96 and 98, respectively fixed thereto to drive the corresponding input roll 28 at the same speed through chains 100, 102 and 104 which through sprockets 106, 108 and 110 drive shafts 34, 901 and 921.

The width control mark 20 on each side of the carpet 10 controls the operation of the piston 112 in response to its detection by the magnetic sensor 114. Depending on the position of the mark 20 the pin wheel 116 will be rotated one way or the other by the piston 112 to control the width of the carpet 10.

Figure 5:
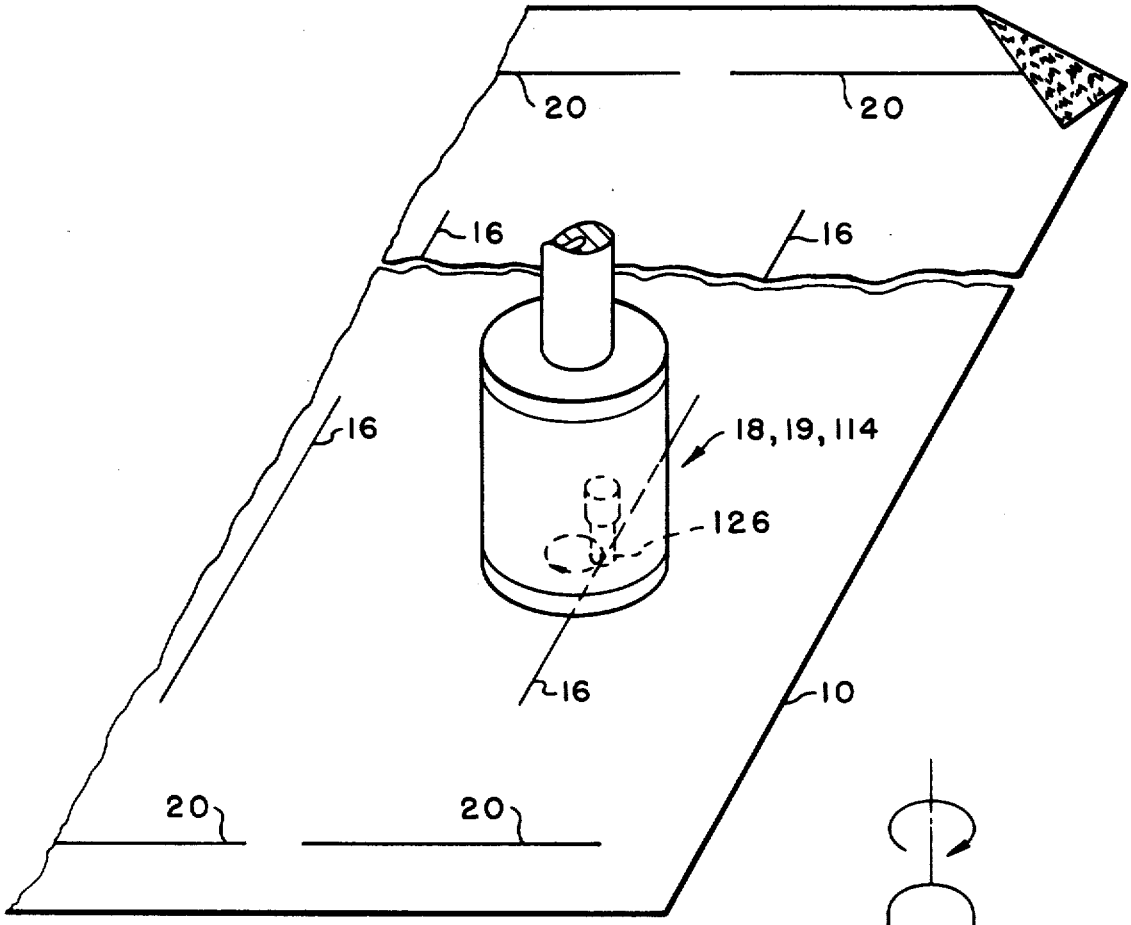
FIG. 5 illustrates the operation of a magnetic sensor sensing a registration line on the back of a fabric.
Figure 6:
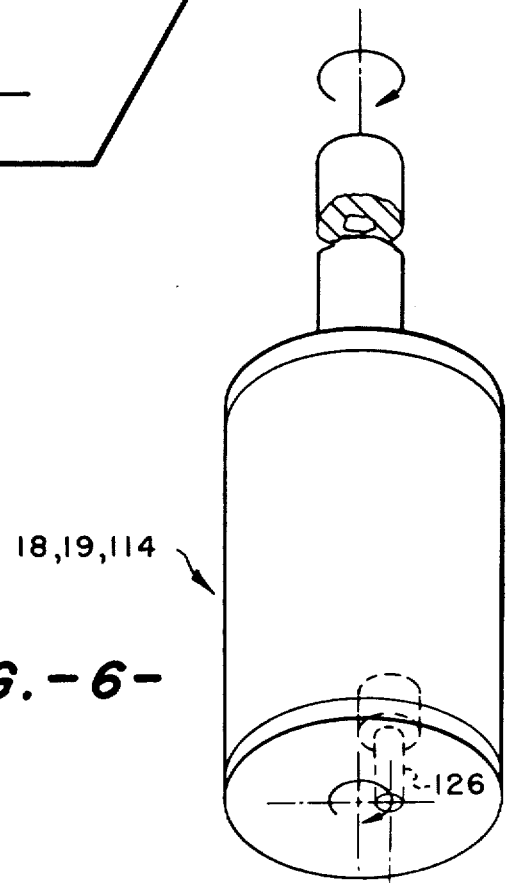
FIG. 6 is a blown-up view of the sensor shown in FIG. 5.

Looking now to FIGS. 5–7 the particular magnetic sensor 18, 19 or 114 is illustrated. The sensor basically consists of a pole piece 116, a coil 118, a permanent magnet 120, two signal wires 122 and 124 and a housing 126, all of which are enclosed in another housing or cylindrical tube generally denoted as the sensor 18, 19 or 114. A magnetic field extends from the magnet 120 through the pole-piece 116 and out into the air space at the end of the pole-piece. The return path of the field is from the air space to the other end of the magnet 120. As a ferrous object approaches the tip of the pole-piece 116, the magnetic field contracts. As the ferrous object passes away from the tip of the pole-piece, the magnetic field expands. When the magnetic field contracts, it induces a voltage in the coil 118 in one direction and when it expands, it induces a voltage in the coil in the opposite direction. The passage of one ferrous object induces one pulse. The magnitude of the voltage induced is proportional to the rate at which a ferrous object approaches or moves away from the top of the pole piece.

In the present applicaton of this sensor, the registration lines can be sensed as long as the fabric is moving at or near its maximum rate of travel; however, the registration lines can not be sensed when the fabric is moving slowly because the magnitude of the induced voltage is too small. In order to overcome this problem the sensor is mounted in the end of the cylindrical tube 18, 19 or 114 which is rotated. Note from FIG. 6 that the center line of the pole piece is located a distance "A" from the center of rotation of the cylinder which in the preferred form of the invenion is 0.25 inches. This arrangement means that the pole piece is moving in a circular path the diameter of which is 0.5 inches. Observe in FIG. 5 that the pole piece passes across the registration line twice for each complete rotation of the cylinder, except when the registration line is tangential to the circular path of the pole piece where a single, but longer intersection of the path of the pole piece with the registration line occurs. With this arrangement the rate of rotation of the cylinder can be adjusted to accommodate registration lines with varying amounts of ferrous material.

OPERATION

In operation, the web of material or carpet 10, which has previously had marking 14, 16 and 20 applied to the back thereof in register with the pattern 12 on the face, is fed through a dyeing and drying process. Then, prior to back coating to provide a backing material thereto, the carpet 10 is supplied to the input rolls 28 of the machine 8. The carpet 10 then passes under the idler roll 30 to the output rolls 32. As the carpet 10 is delivered to the segmented output rolls 38 the markings 14 and 16, as well as the markings 20, are sensed by the rotating magnetic sensors 18 and 19. The pulses generated by the sensors 18 and 19 are supplied to the electronic comparator 130 (FIG. 8) where each of the pulses from the sensors 18 are compared to the reference pulse from the sensor 19 to determine whether the segment of the carpet sensed is traveling slower or faster than the reference segment. Then, depending on the result of the comparison, one of the clutches 54, 56 or 58 for the roll segment driving that portion of the carpet, is energized to either speed up, maintain or slow down that segment of the carpet. The particular clutch energized controls the speed of both the corresponding input and output rolls simultaneously. Since the rows of markings are spaced a predetermined distance from each other, the markings are continuously scanned to maintain the marks in a line to maintain the pattern in registration. In like manner, the mark 20 is scanned by the sensor 114 to control the width of the carpet 10 by actuation of the piston 120 to correctly position the pin wheel 116.

It is obvious that a machine has been described which will automatically and continuously maintain a traveling web of material in the position desired as determined by the sensing marks placed on the back thereof.

Although I have described specifically the preferred embodiment of my invention, I contemplate that changes may be made without departing from the scope or spirit of the invention and I desire to be limited only by the scope of the claims.

I claim:

1. A magnetic sensor to detect a ferrous mark on a moving web of material comprising: a substantially cylindrical housing having a central axis, a sensor mounted in said housing, said sensor having a permanent magnet mounted therein, a pole piece mounted in said sensor adjacent said permanent magnet having its centerline offset from the centerline of said cylindrical housing, a coil in said pole piece adjacent one end of said housing and a plurality of wires connected to and projecting from said sensor to provide a connection means to transmit a voltage generated when said sensor is rotated around a ferrous material.

* * * * *